US006068504A

United States Patent [19]

Gardner et al.

[11] Patent Number: 6,068,504

[45] Date of Patent: May 30, 2000

[54] SELECTIVE TERMINATION CONNECTOR ASSEMBLY

[75] Inventors: Michael J. Gardner, Wheaton; David E. Dunham, Aurora; Gene Whetstone, Batavia, all of Ill.

[73] Assignee: Molex Incorporated, Lisle, Ill.

[21] Appl. No.: 09/149,640

[22] Filed: Sep. 8, 1998

[51] Int. Cl.[7] ..... H01R 11/20; H01R 12/24

[52] U.S. Cl. ..... 439/405; 439/497

[58] Field of Search ..... 439/405, 404, 439/497

[56] References Cited

U.S. PATENT DOCUMENTS

| | | | |
|---|---|---|---|
| Re. 32,439 | 6/1987 | Narozny | 439/404 |
| 3,601,768 | 8/1971 | Lightner . | |
| 3,909,935 | 10/1975 | Aldridge et al. . | |
| 3,955,877 | 5/1976 | Cobaugh et al. . | |
| 4,017,140 | 4/1977 | Reavis et al. . | |
| 4,030,793 | 6/1977 | Hanlon et al. . | |
| 4,066,320 | 1/1978 | Goodrich et al. . | |
| 4,094,564 | 6/1978 | Cacolici . | |
| 4,101,189 | 7/1978 | Moser et al. | 339/99 R |
| 4,209,219 | 6/1980 | Proietto | 339/99 R |
| 4,227,763 | 10/1980 | Marks . | |
| 4,262,984 | 4/1981 | Takahashi | 339/97 R |
| 4,365,856 | 12/1982 | Yaegashi . | |
| 4,377,321 | 3/1983 | Weisenburger . | |
| 4,415,216 | 11/1983 | Narozny . | |
| 4,500,157 | 2/1985 | Huffnagle . | |
| 4,508,415 | 4/1985 | Bunnell . | |
| 4,602,830 | 7/1986 | Lockard . | |
| 4,781,620 | 11/1988 | Tengler et al. . | |
| 5,122,078 | 6/1992 | Davis et al. | 439/405 |
| 5,129,840 | 7/1992 | Kuzonon et al. | 439/397 |
| 5,145,387 | 9/1992 | Ichihashi | 439/108 |
| 5,326,286 | 7/1994 | Bixler et al. | 439/751 |
| 5,358,424 | 10/1994 | Bowen et al. . | |
| 5,376,018 | 12/1994 | Davis et al. . | |
| 5,425,657 | 6/1995 | Davis et al. . | |
| 5,456,617 | 10/1995 | Chishima et al. . | |
| 5,465,479 | 11/1995 | Bowen et al. . | |
| 5,547,391 | 8/1996 | Benes et al. . | |
| 5,577,930 | 11/1996 | Dahlem et al. . | |
| 5,603,633 | 2/1997 | Satoh . | |
| 5,660,563 | 8/1997 | Chevarie et al. . | |
| 5,759,060 | 6/1998 | Wu . | |
| 5,893,773 | 4/1999 | Dellinger | 439/404 |
| 5,967,832 | 10/1999 | Ploehn . | |

FOREIGN PATENT DOCUMENTS

| | | |
|---|---|---|
| 62-500480 | 2/1987 | Japan . |
| 6314575 | 11/1994 | Japan . |
| WO9426004 | 11/1994 | WIPO . |

*Primary Examiner*—Neil Abrams
*Assistant Examiner*—Chandrika Prasad
*Attorney, Agent, or Firm*—Charles S. Cohen

[57] ABSTRACT

An improved mass connector termination assembly reduces mistermination errors and gives dual termination capability for simultaneous termination of selected wires to two different terminals. This simultaneous termination also simplifies the isolation of differential signal wire pairs. Three arrays of terminals are held within a terminal housing and include elongated contact portions that extend within a plug or receptacle portion of the connector housing and insulation displacement portions that extend along a terminating face of the connector. The terminal arrays extend through the connector between these two faces. Multiple contact portions of one of the three terminal arrays are bussed together with a single terminal and these single terminals are aligned with the terminals of the other two terminal arrays.

28 Claims, 8 Drawing Sheets

500
509
508
503
502
505

400
408
406
407'
407
409
405
410
404
404'
402
505
502
500

SELECTIVE TERMINATION CONNECTOR ASSEMBLY

BACKGROUND OF THE INVENTION

The present invention relates generally to connectors for terminating multiple conductors, and more particularly to a connector assembly for selectively terminating multiple conductors and having a structure that permits dual termination of selected conductors, common grounding and isolation of differential signal conductors.

Many electronic devices, especially computers, utilize additional electronic devices which are known in the art as "peripherals". Examples of these peripheral devices are disk drives, CD-ROM drives, digital video disk ("DVD") drives, modems, network adapters, and the like and these peripheral devices utilize power wires and a plurality of signal wires to connect to the computer. These devices utilize ribbon cable for the signal wires for ease of connection to the many associated circuits on the motherboard of the computer.

Ribbon cable consists of a plurality of wires that are formed together as a single extent where the wires are formed together in side-by-side order. The individual conductors of the ribbon cable are surrounded by a flexible insulation. These conductors are spaced close together along the width of the cable and include specific signal and ground conductors corresponding to specific circuits of the peripheral device. In order to terminate such conductors, insulation displacement type terminals ("IDT") are used.

IDT type connectors for ribbon cable include an insulative housing, a mating face for mating with another, complementary conductor, an appropriate cable-receiving face and at least two rows of terminal-receiving passages extending between the two faces. Conductive terminals are received in the passages and each such terminal has a mating portion that extends into the mating face and a U-shaped or a V-shaped insulation displacement portion extending into the cable-receiving face of the connector. A cover is provided to maintain the conductors of the cable into contact with the insulation displacement portions of the terminals.

One problem that occurs with such IDT connectors is a function of the close density of the conductors in the ribbon cable, such as in instances where the wires are spaced on a 0.025 inch pitch. This close spacing of the conductors requires that the insulation displacement portions of the terminals be arranged in two spaced-apart rows wherein the terminals in each row are offset from each other to define, in effect, four rows of staggered IDTs along the cable-receiving face, with adjacent terminals of the connector being located in two distinct rows on the mating face of the connector. Hence, these type of connectors are often referred to as "dual row" connectors in the art. A conductor that will be terminated in either of the rear rows will have to necessarily pass between two insulation displacement terminals of the two forward rows along the cable-receiving face. This close spacing creates problems and may result in shorting where the rear row conductor inadvertently contacts and is pierced by one of the forward IDTs.

One solution to this problem is to modify the physical structure of the connector housing, rather than the structure of the terminals and utilize what is known as a "hill and dale" system to locate adjacent conductors in the IDTs at different vertical levels. This modification of the connector housing complicates the molding of the connector housing and adds to cost of the connector.

Additionally, in these type of IDT systems with dual row terminals, the contact portions of the IDTs are arranged on different sides of the connector mating face. These systems require alternating termination of the first side and then the second side contact portions for successive adjacent conductors in the ribbon cable. This alternating termination must be followed in order to avoid termination of conductors of unfavorable signal types positioned in areas detrimentally affecting differential pairs of signal conductors. The alternating termination must be maintained and therefore detail must be taken in arranging the termination of the conductors to the IDTs to avoid having the unfavorable ground-type signal wires positioned in a manner that will detrimentally affect the signals carried by the differential pairs of signal conductors.

A need therefore exists for an improved connector in which conductors are easily aligned with the respective terminals of the connector and which permits dual termination of certain conductors and which permits differential wire isolation.

SUMMARY OF THE INVENTION

Accordingly, it is a general object of the present invention to provide an electrical connector adapted for the mass termination of multiple conductors in which selected conductors may be selectively dual terminated, differential signal pairs isolated and grounding conductors commoned together.

Another object of the present invention is to provide a connector for terminating flat ribbon multiconductor cable in such a manner that permits the use of inexpensive ribbon cable (having conductors spaced at about 50 mils) and easily maintains separation and isolation of the signal conductors from the ground conductors in the cable.

A still further object of the present invention is to provide a dual row connector for the mass termination of multiple conductors, wherein some of the conductors are arranged as differential pairs of conductors, the connector having a plurality of conductive terminals disposed thereon, the terminals having mating portions that extend in two rows along a mating face of the connector and the terminals having conductor-engaging portions at opposite ends thereof for electrically engaging the conductors, mating portions of selected terminals being commoned together to permit isolation of the differential pairs of conductors.

A further object of the present invention is to provide a connector assembly suitable for use in providing a connection between a peripheral device and a computer motherboard that has plug and play capability wherein the peripheral device may be inserted into and connected to the computer motherboard without opening, turning off or rebooting the computer, and wherein the connector assembly includes an insulative connector housing having two opposing faces, one of the connector housing faces having a receptacle portion adapted to engage a plug connector component of the peripheral device, the other connector face having distinct connector power and signal mating portions, the connector assembly having a plurality of insulation displacement terminals extending between the connector housing faces and being displayed on the connector housing other face in distinct rows, selected ones of the insulation displacement terminals of two of the rows being aligned together along the axes of selected conductors so as to permit dual termination of two different terminals in two different rows to the same conductor.

These objects and advantages are achieved due to the structure of the present invention. In one principal aspect of the present invention, and as exemplified by the preferred embodiment thereof, a connector assembly is provided with an elongated body portion having a plurality of terminal-receiving passages formed therein and extending between two opposing faces thereof. Conductive terminals are received within the passages and are separated into two different groups that respectively include power and signal terminals. The signal terminals have elongated contact blade portions formed at one end that extend through the mating face of the connector assembly. At their opposing ends, the signal terminals include conductor-engaging portions, that in the preferred embodiment, include insulation displacement portions, arranged in at least three distinct rows spaced apart from each other in a first direction. This direction is aligned with the axes of the conductors terminated to the connector assembly so that simultaneous termination of a single conductor to selected, multiple IDTs may be effected.

In another principal aspect of the present invention, the conductors that are terminated to the same terminal are of a given signal type. This permits the selective termination of conductors to grounding terminals on both sides of the receptacle portion thereof in order to easily separate selected signal conductors by surrounding them with ground conductors. This permits continuous reference of a differential signal pair to a designated ground throughout the extent of the conductors.

In yet another principal aspect of the present invention, selected ones of the conductor-engaging portions are commoned together by an extended terminal body portion that interconnects a single conductor-engaging portion to multiple contact blades of the terminal. This structure commons a selected group of terminals on the one face of the connector assembly together. In an alternate embodiment, the terminal body portion may extend for the entire width of the particular terminal array which in effect commons together all of the contact blades connected to and extending therefrom.

These and other objects, features and advantages of the present invention will be clearly understood through consideration of the following detailed description.

DETAILED DESCRIPTION OF THE PREFERRED EMBODIMENTS

Figure 13:
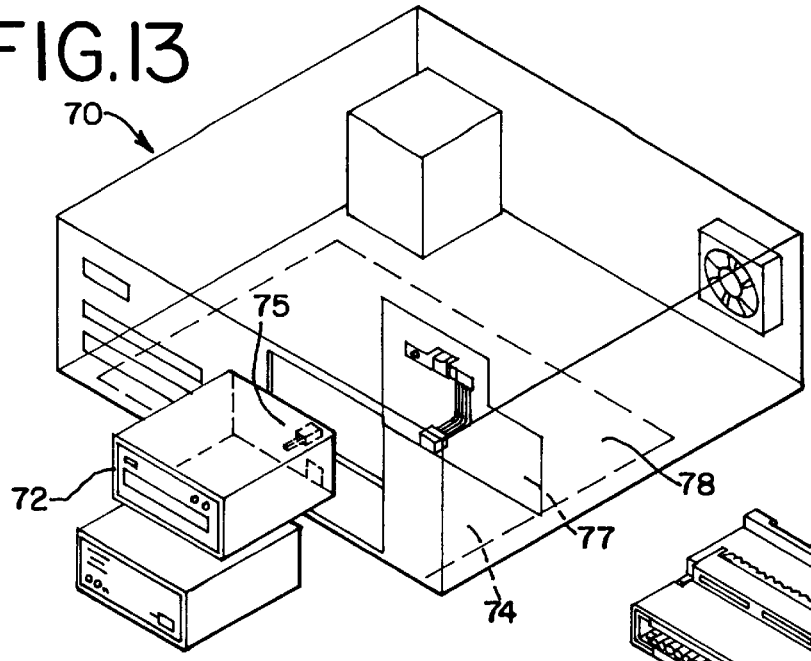
FIG. 13 is a diagrammatic view of an electronic device and peripheral devices therefor that are connected together utilizing connectors of the present invention.

Turning first to FIG. 13, which illustrates one setting in which the present invention finds great utility in providing connections between electronic devices, such as a computer 70 and peripheral devices 72 such as disk drives, CD-ROMS, DVD drives etc. that are adapted to be insertable into and removable from associated device bays 74. The device bay 74 may be opened to the exterior and eliminates the need to open the cabinet of the computer to install the peripheral device 72. The peripheral device 72 is provided with at least one engageable connector 75 that is disposed along a rear face of the device 72. This connector 75 preferably takes the form of a plug-style connector that may be easily inserted into an opposing receptacle-style connector so as to provide the peripheral device 72 with "plug and play" capability.

Figure 2:
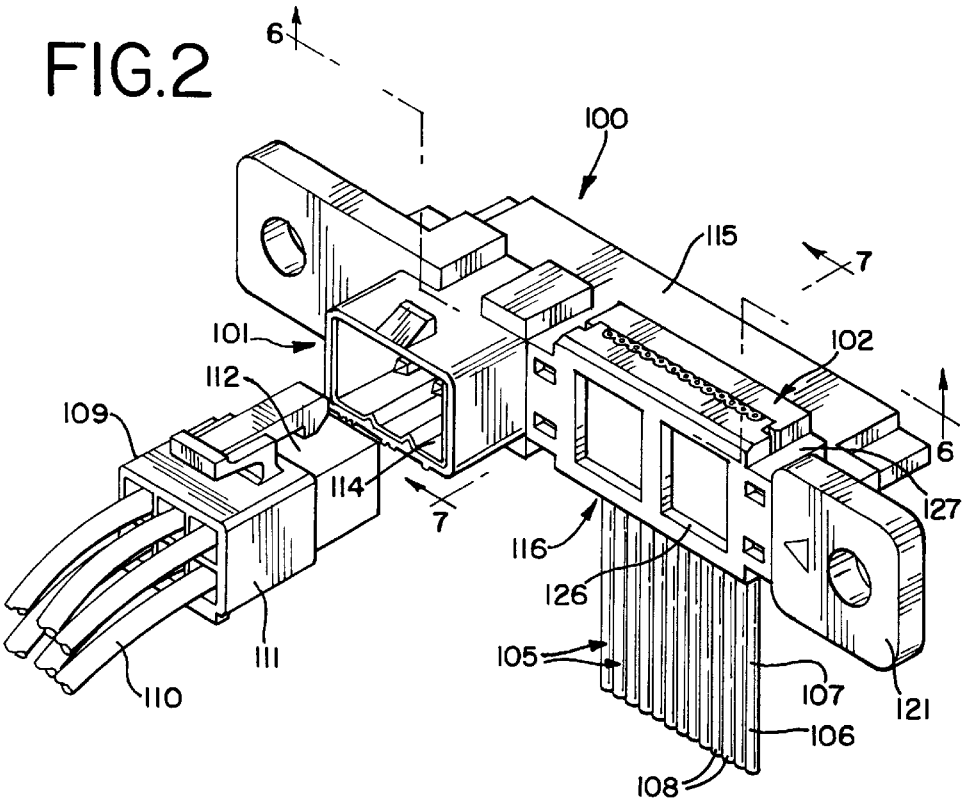
FIG. 2 is a perspective view of a connector assembly constructed in accordance with the principles of the present invention that is particularly suitable for device bay type of connections.

Turning now to FIG. 2, a connector assembly constructed in accordance with the principles of the present invention is designated generally at 100. The connector assembly 100 may be mounted on a bulkhead 77 of the device bay 74 that faces the rear of the peripheral device 72 and the connector assembly 100 includes a connector power portion 101 and a connector signal portion 102, that are intended to respectively connect to a plurality of power wires and signal wires that extend between the connector assembly 100 and a circuit board 78 of the computer 70. The power connector housing 111 has a mating portion 112 that protrudes forward and is received within a corresponding opposing cavity 114 formed in the connector power portion 101 of the connector assembly 100. A plurality of conductive plug-style terminals are housing within the power connector portion 101 for establishing a connection with the power receptacle terminals of the power connector 109.

The connector signal portion 102 of the connector assembly 100 does not mate with an opposing signal connector, but rather includes a plurality of terminals 130 arranged therein that are terminated to a mass of individual conductors 105 that are formed together such as in a ribbon cable 106 flexible printed circuitry or a plurality of wires. As is known in the art, the conductors 105 of the ribbon cable 106 are arranged in side-by-side order and are each surrounded by an insulative covering 107 that is formed as a unit around the conductors 105.

The connector assembly 100 may be considered as having first and second, opposing operative faces 116, 117. In the description to follow, the first face 116 shall be referred to as an interior, or terminating face 116, because it faces the interior of the computer 70 and the ribbon cable conductors 105 are terminated at that face. The second face 117 of the connector assembly shall be referred to as an exterior, or mating face 117, because it faces into the device bay 74, exterior of the computer 70 and because it mates with the opposing plug-style connector 75 of the peripheral device 74.

Figure 15:
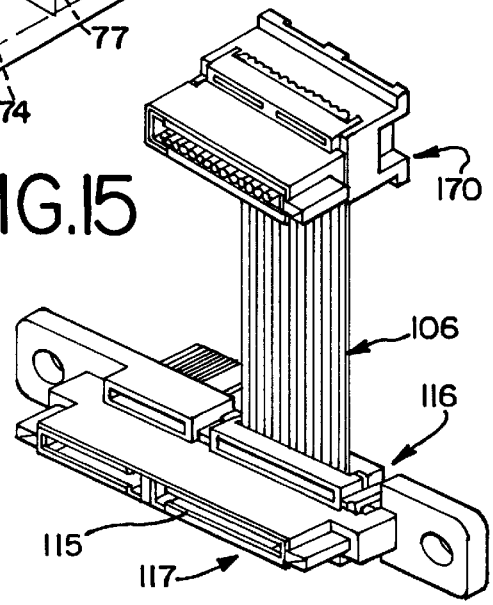
FIG. 15 is a perspective of the connector assembly of FIG. 2 terminated to a mass of conductors which in turn are terminated to another connector component.

The mass of conductors 105 may lead from the connector assembly 100 to another connector component 170 (FIG. 15) for connection to an opposing connector element mounted on a main circuit board, for example. It shall be understood that the device bay application of the connector assembly 100 illustrated is only representative of one application of the present invention. It may also be used in other connector applications, such as a circuit board to circuit board application and other applications where dual termination or isolation of differential wire pairs is desired.

Figure 3:
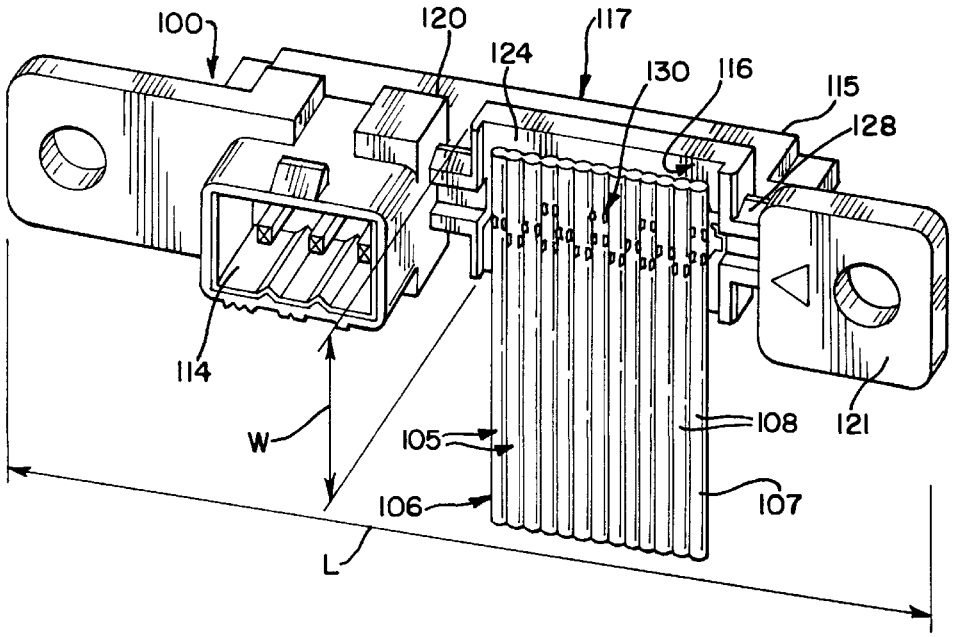
FIG. 3 is a perspective end view of the connector assembly of FIG. 2, with the ribbon cable cover removed for clarity and illustrating the ribbon cable in place upon the insulation displacement terminals of the connector assembly.

As seen best in FIG. 3, the connector assembly includes an elongated connector housing, or body portion 120, formed from an electrically insulative material. The housing 120 includes a pair of mounting tabs 121 extending therefrom on opposite ends of the connector assembly 100 for mounting the connector assembly to a device bay bulkhead 77, as illustrated in FIG. 13, or to an internal support (not shown). The connector power and signal portions 101, 102 are spaced apart from each other along the length L of the connector assembly 100. At the connector signal portion 102, the connector assembly 100 is adapted to electrically engage the mass of conductors 105 formed in the ribbon cable 106. As is common in the construction of ribbon cable 106, the outer insulative coverings 107 of the wires 108 of the ribbon cable 106 are joined together.

The wires 108 of the ribbon cable 106 are terminated to a corresponding number of conductive terminals 130 that are held within the connector housing 120 and are disposed along the terminating face 116 of the connector body 120. The connector signal portion includes a recessed area 124 formed in the connector housing 120 that defines a channel in which the ribbon cable 106 is received. A cover plate 126 may be provided to both enclose the ribbon cable 106 and to force the individual conductors 105 thereof into contact with the insulation displacement portions 141 of the signal terminals 130. The cover plate 126 may be provided with latch arms 127 that engage corresponding, opposing ribs 128 formed on the connector housing 120.

Figure 8:
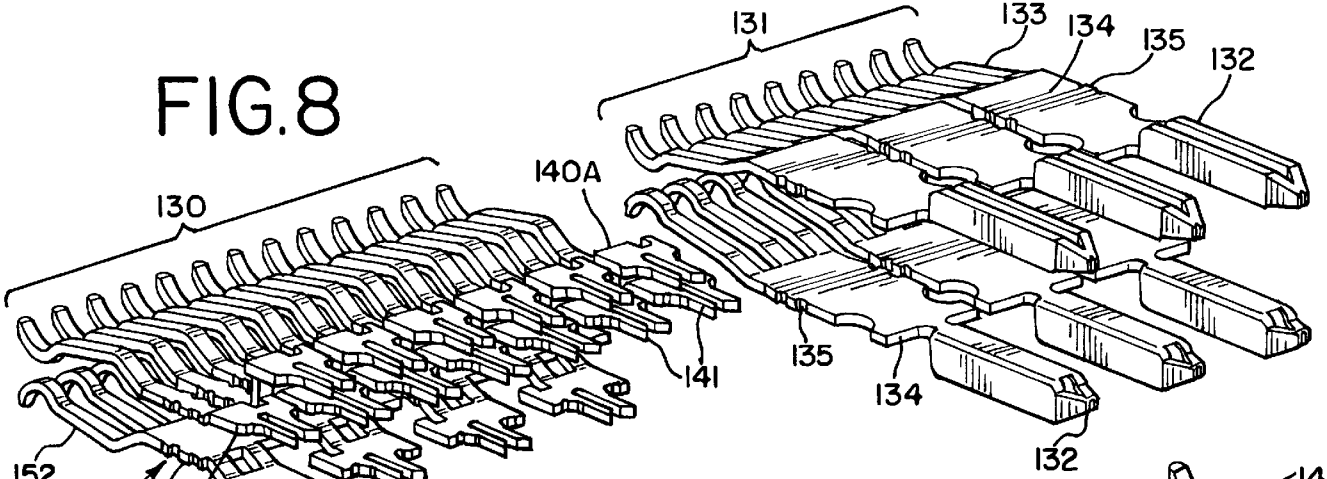
FIG. 8 is a perspective view of the terminal arrays used in the connector assembly of FIG. 3 and removed from the connector body illustrating the relative placement of the terminals within the connector body.

As mentioned above, the connector assembly 100 includes a plurality of terminals 130, 131, and as best illustrated in FIG. 8, these terminals are provided in two different groups. The terminals 130, 131 are received within the corresponding connector power and signal portions 101, 102 of the connector assembly 100. The power terminals 131 extend in passages between the opposing faces 116 and 117 of the connector housing 120 and include elongated plug portions 132 at their ends along the terminating face 116 of the connector assembly 100 that are received within corresponding opposing receptacle terminals of the power connector 109. (FIG. 2.)

The power terminals 131 also include a plurality of elongated contact portions 133 at their opposing ends that are disposed along the mating face 117 of the connector assembly and the two terminal portions 132 and 133 are interconnected by a wide, planar body portion 134. The body portion 134 preferably has a series of housing engagement portions 135, such as barbs, or tangs, that will engage opposing surfaces of the terminal receiving passages of the connector housing 120. The contact portions 133 extend slightly downward from the body portion and are received within a mateable, receptacle portion 115 of the connector assembly 100. This receptacle portion 115 typically will extend outwardly from the mating face 117 of the connector assembly in order to mate with an opposing connector component.

Figure 4:
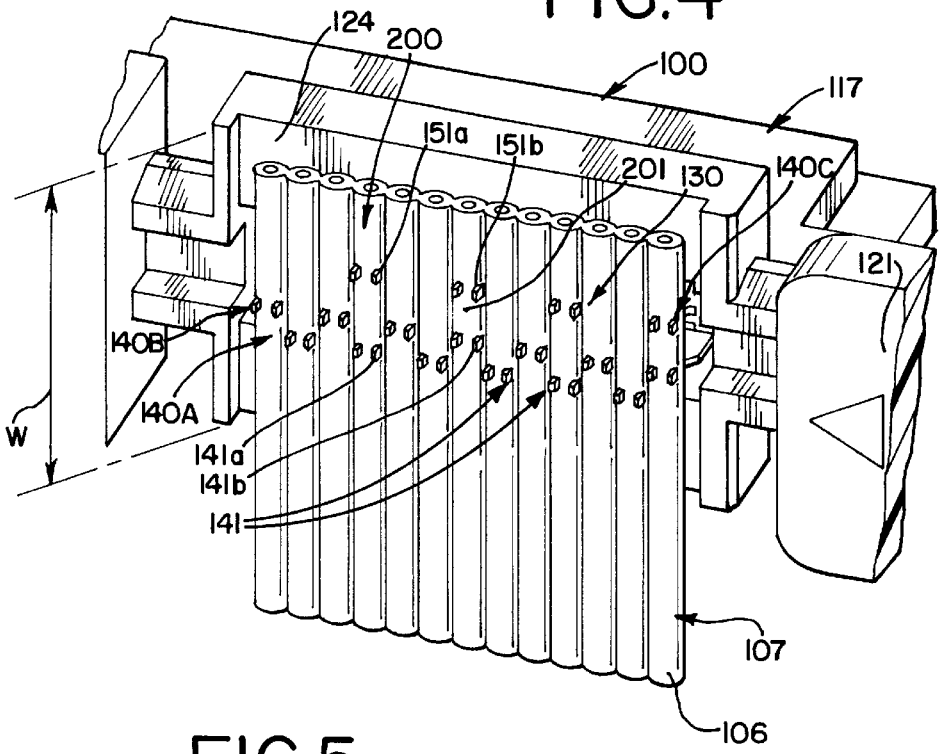
FIG. 4 is an enlarged detail view of the ribbon cable termination area of the connector assembly of FIG. 3.
Figure 5:
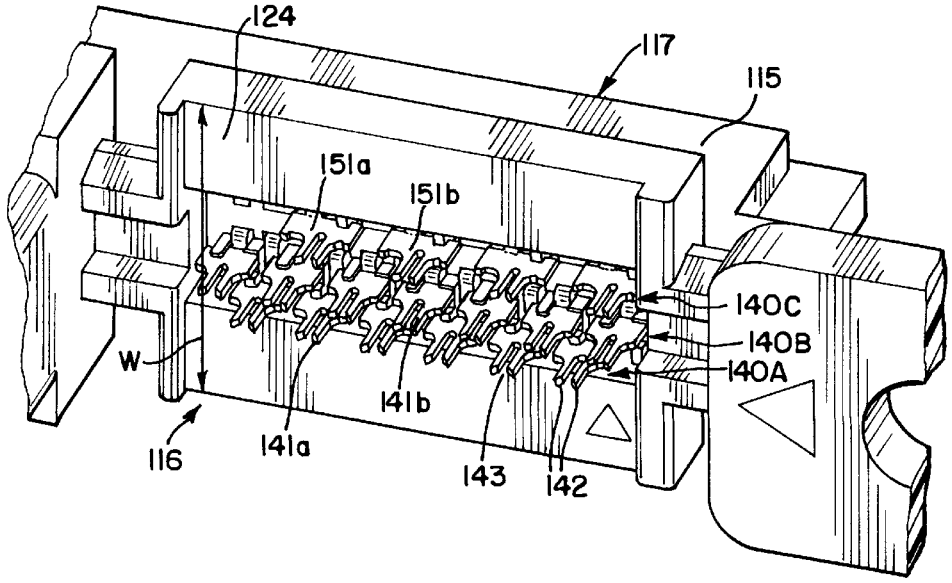
FIG. 5 is an enlarged detail view of the ribbon cable termination area of the connector assembly of FIG. 4, with the ribbon cable removed for clarity and illustrating the rows of signal and ground insulation displacement terminals in place therein.
Figure 6:
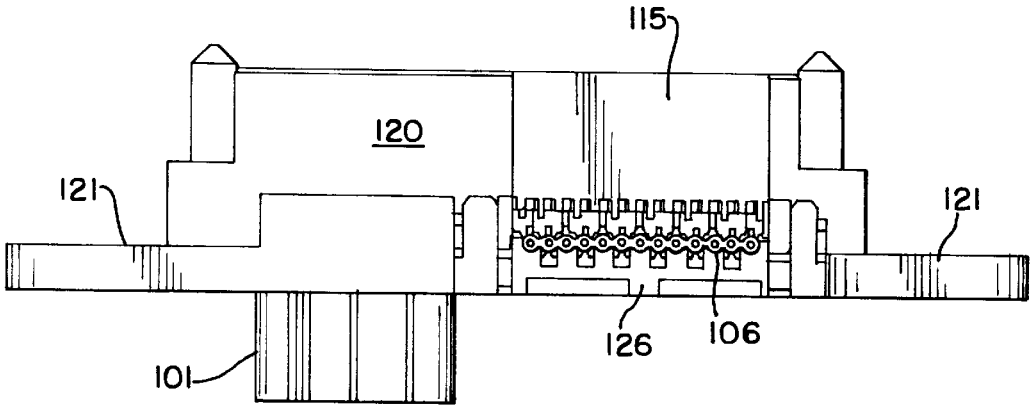
FIG. 6 is a plan view of the connector component of FIG. 2, taken from the bottom side thereof and along lines 6—6 thereof.
Figure 9:
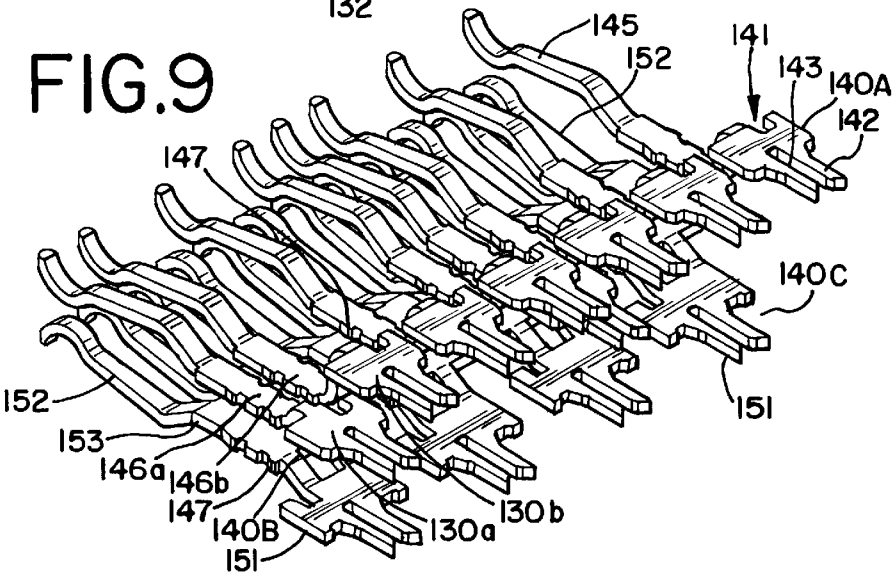
FIG. 9 is a perspective view of only the insulation displacement terminals of FIG. 8, with some of the terminals of the middle array removed for clarity.

Turning now to the signal terminals 130 utilized in the connector assembly 100, it can be seen from FIGS. 8 & 9, that in the preferred embodiment, the signal terminals 130 are arranged in three distinct arrays 140A–C in which the terminals 130 of each array 140A–C are spaced apart from each other along the width W of the connector housing 120. (FIG. 4 & 5.) The terminals 130 are further spaced apart from each other lengthwise within each of the distinct arrays 140A–C.

Figure 7:
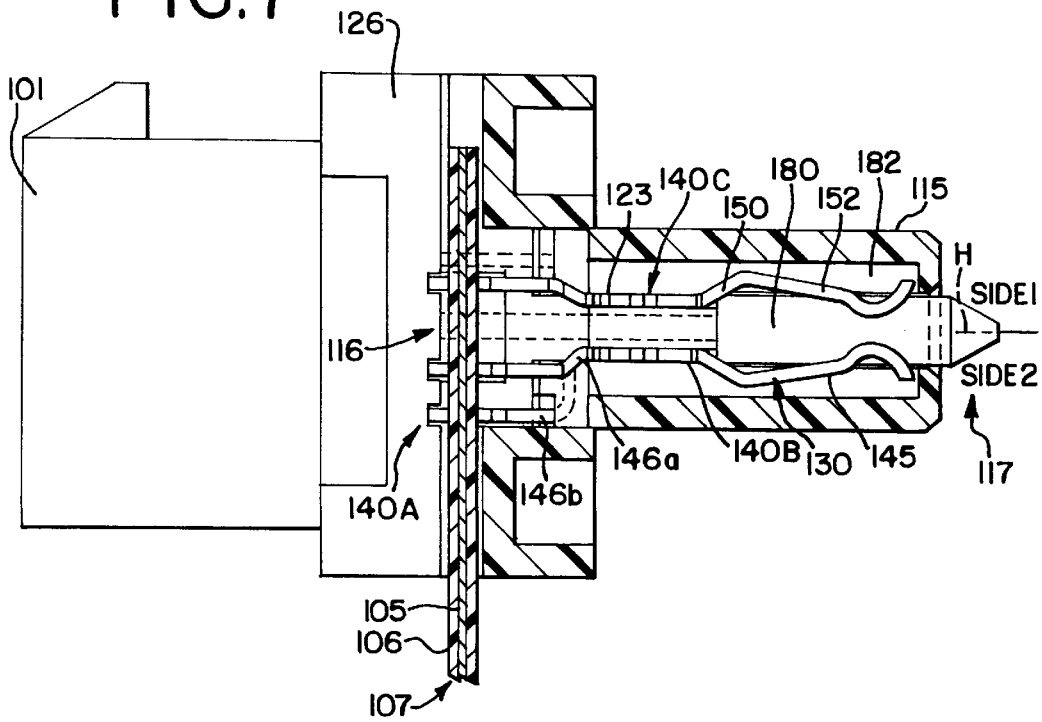
FIG. 7 is an enlarged cross-sectional view of the connector assembly of FIG. 2 taken along the lines 7—7 and illustrating the relative placement of the rows of terminals therein.

The signal terminals 130 are arranged within terminal-receiving passages 123 formed in the connector housing 120 (FIG. 7) and which communicate with the terminating face 116 of the recessed area 124 and the receptacle portion 115 of the connector housing 120. The receptacle portion 115 is shown for purposes of illustration only, and it will be understood that this mating face 117 of the connector assembly 100 may take other mating forms, such as a plug portion. The receptacle portion 115 illustrated (FIG. 15) is adapted to mate with an opposing plug portion of a mating connector (not shown). As illustrated best in FIGS. 7 & 11, the connector housing 120 has an open area 180 that constitutes the receptacle portion 115. This open area 180 contains a series of elongated recesses 182 that accommodate the contact portions of the terminals, with the contact portions 152 of the grounding terminals 150 of the third terminal array 140C being shown in the recesses 182 in FIG. 11. These contact portions 152 are arranged along one row, or side, of the connector assembly receptacle portion 115. The terminal-receiving passages 123 are of a width slightly less than the width of the terminal body portions 146*a*, 146*b*, especially at the housing retention portions thereof. These passages 123 are spaced apart from each other at different levels, or elevations, within the connector housing 120 as shown in FIG. 7.

The terminals of the connector assembly are illustrated removed from the connector housing in FIG. 8 to show the relative placement of the terminals with respect to each other. FIG. 9 illustrates only the signal terminals 130, and in FIG. 9, some of the terminals of the middle terminal array 140B have been removed for clarity. Focusing particularly on the terminals 130 of the first two arrays 140A and 140B, each such terminal 130 includes a U-shaped or V-shaped insulation displacement terminal portion ("IDT") 141 that includes a pair of insulation displacement arms 142 that are separated by an intervening slot 143. As is known in the art, in order to effect termination of a conductor 105 to such a terminal 130, the ribbon cable 107 is forced down onto the IDT in a manner so that the conductor 105 thereof is forced into the slot 143 of the terminal, while the flanking displacement arms 142 pierce the insulative covering 107 and contact the inner conductor 105.

Each terminal 130 in these two rows, or arrays 140A, 140B further includes an elongated contact portion 145 in the form of a contact blade that extends through the mating face 116 of the connector assembly 100 and is housed within a receptacle housing 115 formed thereon. (FIG. 7.) The receptacle portion 115 extends from the connector housing 120 and encloses the contact portions 145, 152 of the terminals 130.

As shown in FIG. 9, the contact portions 145 and the IDT portions 141 of the terminals of the two terminal arrays 140A, 140B are interconnected together by integral terminal body portions 146. These body portions 146*a*, 146*b* may include connector housing retention portions 147 that engage opposing surfaces 149 of the terminal-receiving passages 123 of the connector housing 120. In order to maintain the contact portions 145 of the two terminal arrays 140A, 140B at the same level within the receptacle portion 115, the body portions 146*a*, 146*b* of the terminals in the respective two terminal arrays 140A, 140B are offset from the IDT portions 141, with the body portions 146*b* of alternating terminals 130*b* being larger than the corresponding body portions 146*a* of adjacent terminals 130*a*. In this manner, the first two terminal arrays 140A, 140B are offset in the vertical direction, i.e., along the width W of the connector housing 120 at the recessed area 124 of the connector assembly terminating face 116.

Figure 10:
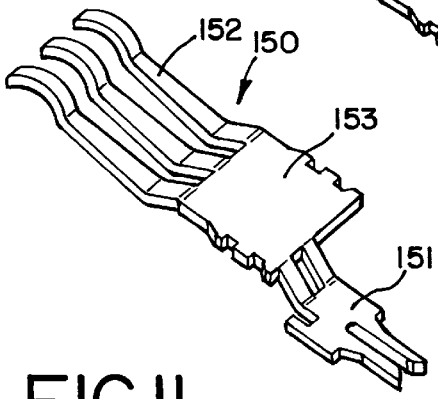
FIG. 10 is a perspective view of one of the grounding insulation displacement terminals of the array of terminals of FIG. 10 illustrating one IDT commoned to three different grounding terminals in the form of elongated contact blades.
Figure 11:
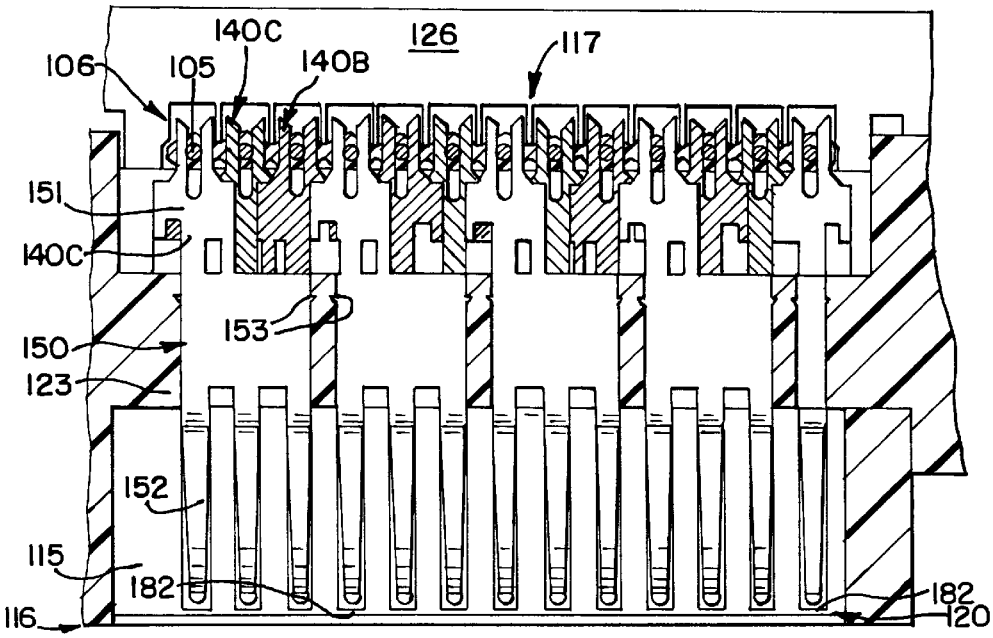
FIG. 11 is a sectional view of a portion of the connector assembly of FIG. 2, illustrating view of the grounding terminals of FIG. 9 in place within the connector body.

In an important aspect of the present invention, a third terminal array 140C is provided in which selected ones, or all of the relevant contact portions of a terminal array are joined or "bussed" together so that they may be commonly connected at the same connection point(s). One terminal 150 of such a terminal array 140C is illustrated in FIGS. 10 & 11. As shown, the terminal 150 has an insulation displacement portion 151 and multiple contact portions 152 that are interconnected by an integral body portion 153 having a width greater than the width of the body portions 146*a*, 146*b* of the terminals in the other two terminal arrays 140A, 140B. This increased width permits the terminal 150 to accommodate the multiple contact portions 152 at their desired spacing within the receptacle portion 115.

Figure 12:
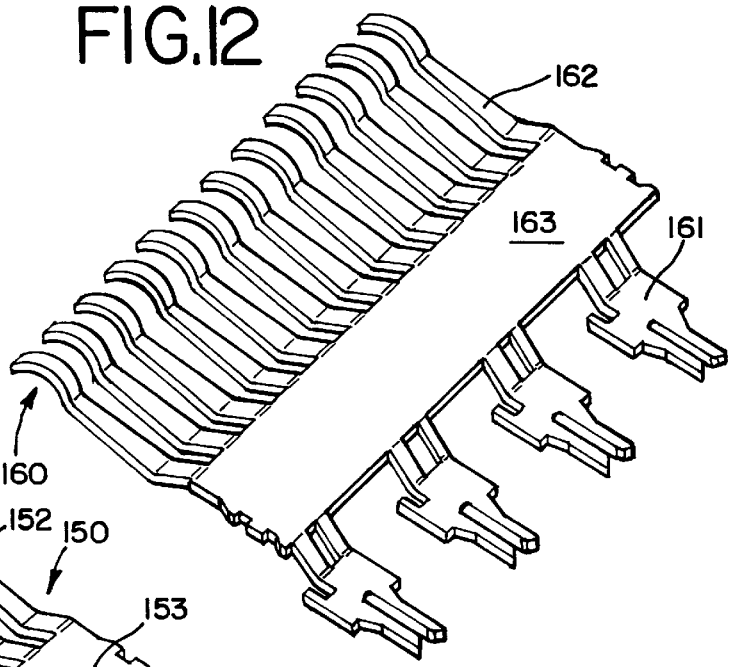
FIG. 12 is a perspective view of an alternate array of grounding insulation displacement terminals that are commoned together as a single piece.

This permits multiple contact portions 152 that carry the same signal to be bussed for a common connection to a central termination point. Typically, the signals carried by the contact portions 152 and IDT portions 151 of these terminals 150 will be ground. The bussing need not be limited to only the selected three terminal arrangement shown. As illustrated in the terminal array 160 of FIG. 12, if desired, all of the contact portions 162 may be bussed together at a single, wide body portion 163 for a common ground or other connection.

In some instances where selected ones of the contact portions of the first two terminal arrays 140A, 140B carry the same signals as those carried by selected terminals of the third terminal array 140C, the present invention permits the simultaneous termination of the two (or more) IDTs at a given location in the ribbon cable 106. This is shown in FIG. 4 where it can be seen that one wire 200 of the ribbon cable 106 is terminated to both an IDT portion 151*a* of the third terminal array 140C and an IDT portion 141*a* of the first terminal array 140A, and where another wire 201 of the cable 106 is terminated to both an IDT portion 151*b* of the third terminal array 140C and an IDT portion 141*b* of the second terminal array 140B.

Figure 14A:
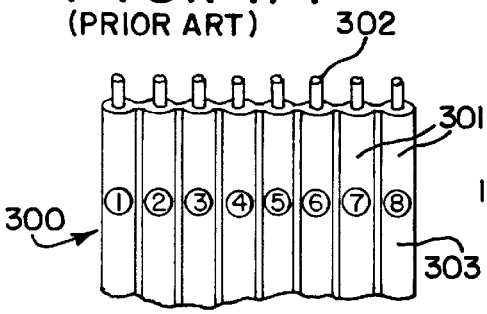
FIG.14A (PRIOR ART)
FIG. 14A is a diagrammatic plan view of a conventional ribbon cable containing eight separate conductors.

This structure reduces the number of IDTs that are present on the terminating face 116 of the connector assembly 100 and significantly avoids some of the problems commonly associated with known IDT connectors that have four rows of IDTs arranged across a terminating face thereof. These problems are best explained with reference to FIGS. 14A–C. FIG. 14A illustrates, in plan view, a ribbon cable 300 having eight wires 301 formed together as a unit. Each wire has its own conductor 302 that is enclosed by an insulative covering 303. Each of these eight wires are identified by respective numbers "1" through "8" in FIG. 14A–C. As seen in FIG. 14A, the wires 301 are shown in odd and even-numbered fashion. The wires 301 are terminated to a connector in this fashion as well.

Figure 14B:
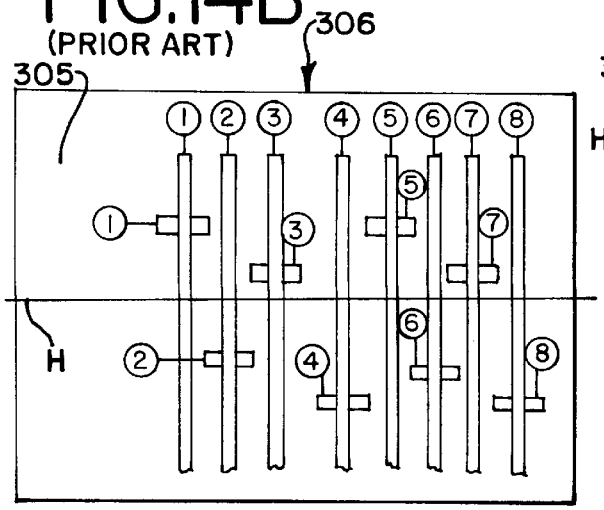
FIG.14B (PRIOR ART)
FIG. 14B is a diagrammatic view of the terminating face of a conventional ribbon cable connector illustrating the pattern of terminating the ribbon cable conductors to the four rows of terminals of the connector.
Figure 14C:
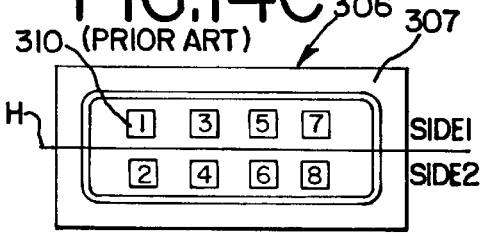
FIG.14C (PRIOR ART)
FIG. 14C is a diagrammatic end view of the opposing, mating face of the connector of FIG. 14B illustrating the terminal locations on the two sides of the mating face.

FIG. 14B diagrammatically illustrates the terminating face 305 of a known dual row, ribbon cable connector 306 that has a plurality of conductive terminals 309 held within the connector 306 and having insulation displacement portions 308 exposed on the terminating face thereof. The other end of the terminals 309 include contact blade portions 310 that are arranged in two opposing rows on a mating face 307 of the connector, hence the term "dual row" ribbon cable connector. The mating face 307 of this connector 306 is shown in FIG. 14C and lies on the other side of the connector 306, opposite the terminating face shown in FIG. 14B.

These two rows of contact blade portions 310 are arranged on opposite sides of a centerline H of the mating face 307. The mating face 307 may take the form of either a plug-style connector face where the contact blade portions 310 are disposed on opposite sides of the plug portion, or the mating face 307 may take the form of a receptacle-style connector face where the contact blade portions 310 are disposed within a receptacle on opposite sides of the centerline H. No matter what shape the mating face 307 may take, the IDT portions 308 are arranged in a dual row configuration, meaning that the first terminal, "1" is positioned on "side 1" of the mating face 307 and is terminated to wire "1" of the ribbon cable 300; the second terminal "2" is positioned on "side 2" of the mating face and is terminated to wire "2" of the ribbon cable; terminal "3" is positioned on side "1" of the mating face and is terminated to wire "3"; terminal "4" is positioned on side "2" of the mating face and is terminated to wire "4", and so on. Terminals "3" and "4"

are respectively offset from terminals "1" and "2", as are the other terminals.

This type of alternating termination between sides or rows of the connector is necessary to accommodate the linear conductor arrangement of the ribbon cable 300. This construction does not always permit the isolation of differential signal pairs as in the present invention. Additionally, the use of four offset rows of terminals increases the likelihood of problems occurring during termination, especially with close density ribbon cable of the order of 25 pitch. For example, during the termination process, wire "5" in FIG. 14B must pass between terminals "4" and "6" on the terminating face 305. If that wire moves out of alignment in its path to terminal "5", it may nick or contact either of terminals "4" and "6", thereby shorting out the circuit of wire "5" and the circuits of either wires "4" or "6". This shorting will render the connector inoperable for accurate signal transmission.

The present invention reduces the number of rows of IDTs positioned on the terminating face of the connector assembly and also permits the use of larger, less expensive wire as the ribbon cable, such as 50 pitch ribbon cable (0.050 inches), which is easier to terminate than smaller 25 pitch cable. The bussing of the contact portions 152 of the terminals 150 of the third terminal array 140C eliminates the aforementioned shorting problem that may occur between adjacent IDTs on the terminating face 116 of the connector assembly 100.

Moreover, the bussing of the ground contact portions 152 to a single IDT portion 151 and the dual termination of selected conductors provides an advantageous grounding isolation around pairs of differential signal wire terminals. This is shown best in FIG. 1, wherein the connector signal portion 102 of a connector assembly 100 of the present invention is represented diagrammatically. This connector is a dual row, ribbon cable connector because it has two rows of thirteen contact portions located on opposite sides of a centerline H of the mating face 117 of the connector (that lies opposite the terminating face 116 depicted). Three arrays of terminals 140A–C are shown disposed spaced apart along the width W of the connector housing 120 and the terminals 130 within each row being spaced apart from each other lengthwise of the connector housing 120.

Figure 1:
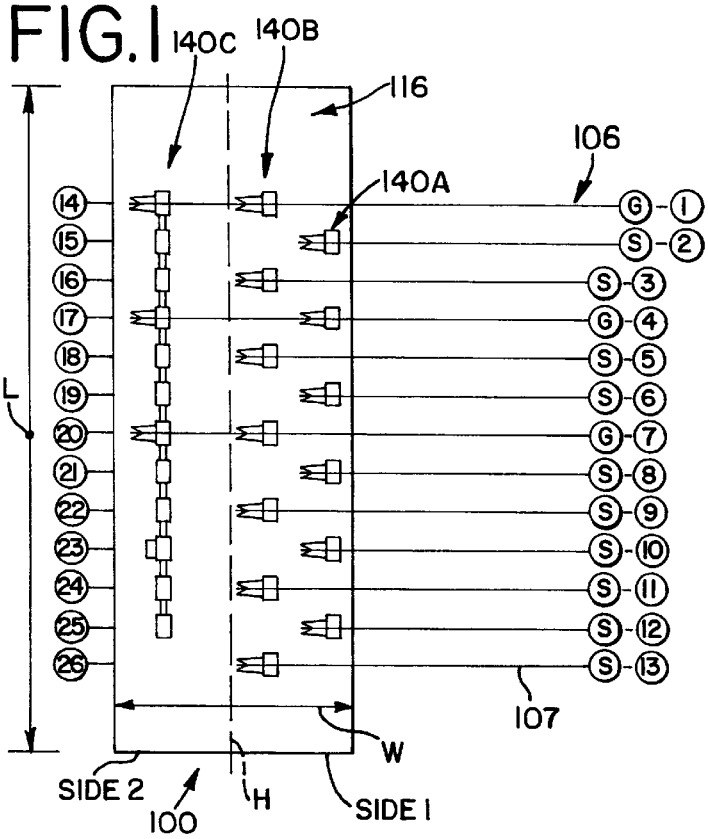
FIG. 1 is a schematic view of an insulation displacement connector constructed in accordance with principles of the present invention and illustrating dual termination of conductors, isolation of signal reference conductors and common grounding of selected conductors.
Figure 1A:
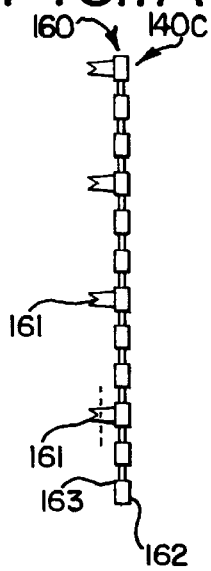
FIG. 1A is a partial detailed schematic view of a portion of the connector of FIG. 1 illustrating an array of grounding terminals commoned together and how selected grounding terminals are trimmed.
Figure 1B:
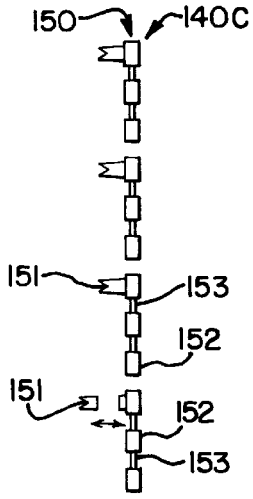
FIG. 1B is a partial detailed schematic view of a portion of the connector of FIG. 1, illustrating an alternate array of commoned grounding terminals in which selected groups of grounding terminals are isolated from each other.
Figure 1C:
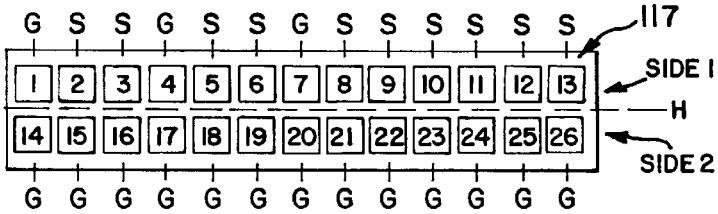
FIG. 1C is a schematic end view of the connector of FIG. 1 illustrating the mating face thereof and the signal-grounding ordering of the wires.

All of the contact portions of the third terminal array 140C are located in one row on one side of the connector mating face, while the contact portions of the first and second terminal arrays 140A, 140B are disposed in one row on the other side of the connector mating face. The individual wires of the ribbon cable 106 have been given numbers 1–13 in FIG. 1 and have also been given signal designations of either "S" or "G", wherein "S" stands for a non-ground signal and "G" stands for a ground signal that is carried by the designated wires. As seen in the upper right of FIG. 1, ground wire "1" is terminated to both a terminal in the second terminal array 140B and a terminal in the third terminal array 140C. All of the contact portions of the terminals 160 in the third terminal array 140C are bussed together as shown. Wire numbers "2" and "3" are differential signal wires that carry complementary signals between the peripheral device 72 mated to the connector assembly 100 and the computer motherboard 78. The next wire, "4" is a ground wire that is terminated to terminals in both the first and third arrays 140A, 140C. As shown in FIG. 1C, the two differential pairs of signal wires "2" and "3" are now therefore isolated from other, possibly unfavorable, signal wires that could introduce crosstalk and other interference into the pair of signal wires "2" and "3".

This isolation occurs on both sides "1" and "2" of the mating face 116 and on opposite sides of the centerline H. All of the contact portions 162 of the terminals 160 in the third terminal array 140C are bussed together in a manner much the same as that shown in FIG. 12. Alternatively, as shown in FIG. 1B, selected contact portions of the third terminal array 140C may be separated into discrete groups, such as the three contact portions associated with each IDT portion as shown in FIGS. 1A and 10. In instances where dual termination of certain wires is not desired, the IDT portions 161 may be cut off as in FIG. 1A in order to remove the termination point in the third terminal array 140C to prevent termination thereto.

As illustrated in FIG. 7, the contact portions 145, 152 of the three terminal arrays 140A–C are positioned with the receptacle portion 115 on opposite sides of the centerline H of the mating face 117 of the connector assembly. By commoning some or all of the contact portions 152 of the third array terminals 150, 160 together, the contact portions of the terminals may be positioned on a single side (Side 2) of the connector mating face 117, as illustrated in FIGS. 1 & 7.

Still further benefits may be obtained from the present invention in the manufacturing of the connector assembly 100 in that the structure of the third terminal array 140C is such that it permits a favorable progression during die stamping. The IDT portions may be selectively cut off, preferably using a one-up die to eliminate unfavorable termination locations that would otherwise result in unfavorable signal conductors located in areas on the connector assembly 100 that would detrimentally affect differential signal pairs.

Figures 16, 17:
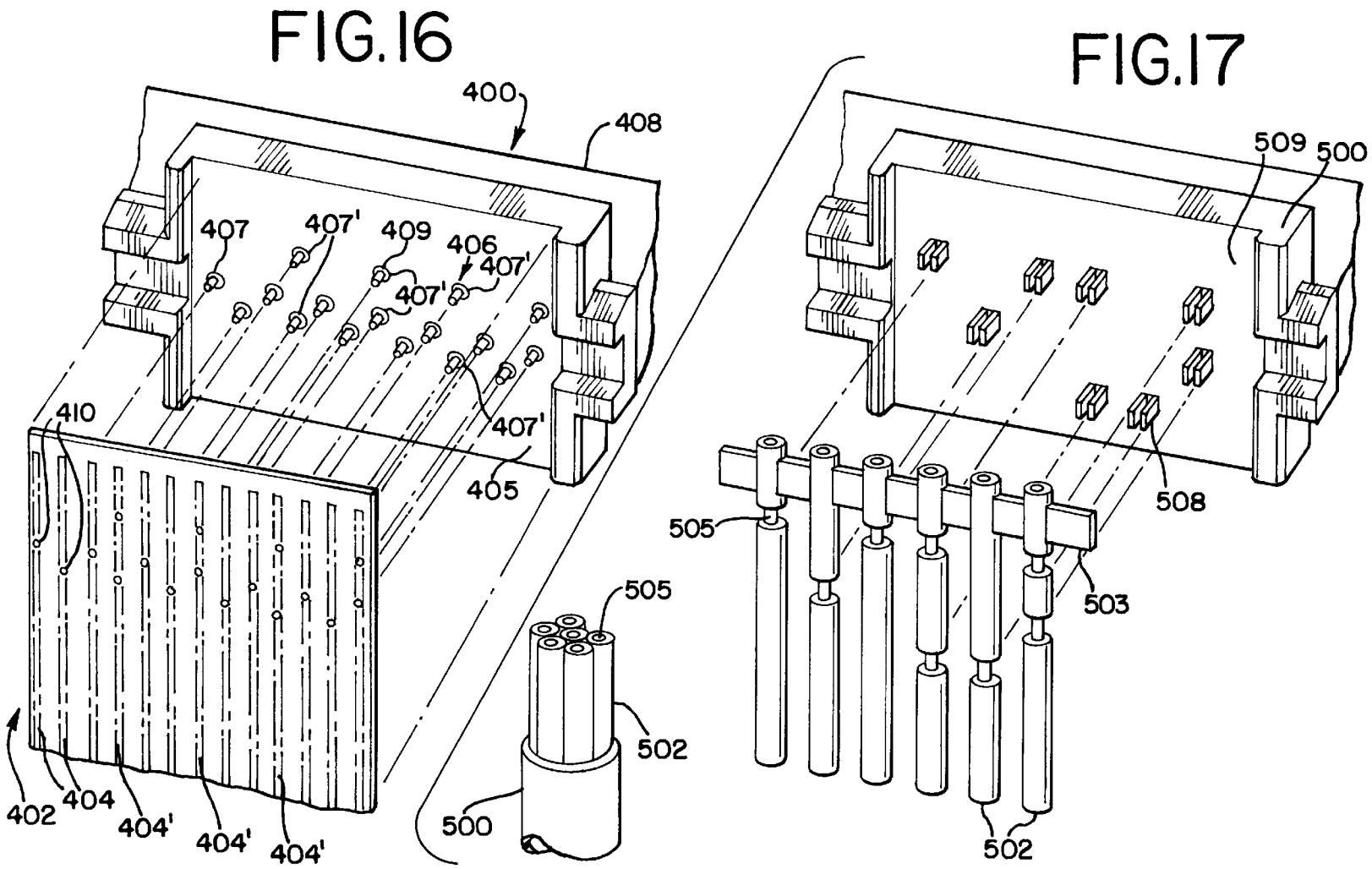
FIG. 16 is a perspective view of an alternate embodiment of a connector assembly incorporating the principles of the present invention; and, FIG. 17 is a perspective view of another alternate embodiment of a connector assembly incorporating the principles of the present invention.

The present invention lends itself to the termination of other mass conductors. For example, FIG. 16 illustrates a connector assembly 400 that is used to terminate an extend 402 of flexible film circuitry or flexible printed circuitry. The flexible circuitry 402, as known in the art may indicate a base layer and a signal transmission layer overlying the base layer. The signal transmission layer includes a plurality of individual conductive traces 404 that may be terminated to or otherwise covered by a insulative outer layer.

The connector assembly 400 includes a terminating force 405 that has a series of conductive terminals 406 extending therethrough, shown in the form of studs, or posts 407. These posts 407 have contact portions that extend through an opposing mating face 408. These posts 407 may have a solder supply 409 disposed around their bases. For termination purposes, the flexible circuitry 402 will have an array of openings 410 punched therein in alignment with selected signal traces 404. Some of the signal faces 404' may be terminated to two different posts 407'. One row of the terminals 406 may have their contact portions combined together similar to the manner described above and shown in FIG. 10, in order to permit the isolation of differential pairs of wires. Other types of soldering terminals may also be used.

FIG. 17 illustrates the use of the present invention in the context of termination of a wire bundle 500 having a plurality of twisted wire pairs 502. The wire paris 502 with the wire bundle 500 may be untwisted and arranged in order, or "dressed" and held in such order by a wire management device 503. The inner conductors 505 with the wires may be exposed and terminated to terminals 508 on a terminating face 509 with the connector 100. Portions of the wire insulation will be removed to expose the inner conductive cores and the cores are then attached to the terminals 509, by soldering, by insulation displacement or other suitable means. Thus, it will be appreciated that the present invention is not limited in its utility only to ribbon cable termination.

While the preferred embodiment of the invention have been shown and described, it will be apparent to those skilled in the art that changes and modifications may be made therein without departing from the spirit of the invention, the scope of which is defined by the appended claims.

What is claimed is:

1. An electrical cable connector for insulated, multiconductor cable, the cable including a plurality of wires, each of the wires having an axial in a first direction and a conductive core extending in the first direction, the conductive core being surrounded by an insulative covering, the connector comprising:

a connector housing having a mating face for mating with a complementary connector component, and a terminating face that receives said cable thereon in an orientation for termination, said connector housing having a plurality of terminal-receiving passages extending through said connector housing between said connector housing two faces, a plurality of conductive terminals disposed in the terminal-receiving passages in distinct first second and third arrays of terminals, said terminals in said first and second arrays each having an elongated mating portion that is associated with said connector housing mating face and an insulation displacement portion that is associated with said connector housing terminating face, said terminals of said third terminal array each having an elongated mating portion that is associated with said connector housing mating face and an insulation displacement portion that is associated with said connector housing terminating face, selected insulation displacement portions of said third terminal array being axially aligned with selected insulation displacement portions of either of said first and second terminal arrays, to thereby permit dual termination of selected single conductors of said cable to different terminals in at least two of said three terminal arrays;

said mating portions of said third terminal array being disposed along one side of said centerline of said connector housing mating face and said mating portions of said first and second terminal arrays being disposed along said connector housing mating face on an opposite side of said mating face centerline, certain of said first and second terminal array terminals being flanked on opposite sides by terminals of said first and second terminal array terminals aligned with said third terminal array terminals so as to electrically isolate said first and second terminal array remaining terminals when said cable wires are terminated to said insulation displacement portions of said first, second and third terminal arrays.

2. The cable connector of claim 1, wherein each of said terminals include conductive body portions that interconnect said mating and insulation displacement portions together and which are integrally formed as a single terminal, said body portions of said third array terminals having a width greater than corresponding widths of said mating portions connected thereto.

3. The cable connector of claim 1, wherein said insulation displacement terminals of said first, second and third terminal arrays are spaced apart from each other in said first direction along said connector housing cable-receiving face.

4. The cable connector of claim 3, wherein said insulation displacement terminals of said first terminal array are offset from said insulation displacement terminals of said second terminal array in a second direction along said connector housing cable-receiving face.

5. The cable connector of claim 4, wherein said first and second directions are generally perpendicular to each other.

6. The cable connector of claim 3, wherein some of said selected insulation displacement terminals of said third terminal array are aligned in said first direction with corresponding insulation displacement terminals of said first terminal array and wherein others of said selected insulation displacement terminals of said third terminal array are aligned in said first direction with corresponding insulation displacement terminals of said second terminal array.

7. The cable connector of claim 1, wherein said first, second and third terminal arrays are spaced apart from each other along said connector housing cable-receiving face in said first direction, and said mating portions of said third terminal array terminals extend in a first row along one side of said connector housing mating face and said mating portions of said first and second terminal array terminals extend in a second row along another side of said connector housing mating face, the two sides being on opposite sides of a centerline thereof.

8. The cable connector of claim 1, wherein each of said terminals of said third terminal array are bussed together by way of a conductive body portion commonly interconnecting said insulation displacement portions to said plurality of mating portions.

9. The cable connector of claim 1, wherein said connector housing mating face includes a receptacle portion disposed thereon that encloses said mating portions of said first, second and third terminal arrays.

10. The cable connector of claim 9, wherein said mating portions of said first, second and third terminal arrays extend through said connector housing mating face.

11. The cable connector of claim 1, wherein said terminals of said third terminal array include a single, conductive body portion interconnecting said third terminal array insulation displacement portions and said mating portions together.

12. The cable connector of claim 1, wherein each of said terminals of said third terminal array include conductive body portions interconnecting one of said third terminal array insulation displacement portions with said plurality of mating portions, said body portion, insulation displacement portion and said mating portions being integrally formed together as a one-piece structure.

13. The cable connector of claim 1, wherein said mating portions of said third terminal array establish electrical signal paths for carrying identical electrical signals when said connector is mated to said complementary connector component and when electricity is applied to said terminals of said connector, and said terminals of said first and second terminal arrays which are aligned with said third terminal array terminals also establish electrical signal paths for carrying said identical electrical signals when electricity is applied to said connector terminals, while the remaining terminals of said first and second terminal arrays establish different electrical signal paths for carrying different electrical signals when electricity is applied to said connector terminals.

14. The cable connector of claim 1, wherein said mating portions of said first, second and third terminal arrays extend through said connector housing mating face and wherein said insulation displacement portions of said third terminal array extend through said connector housing terminating face.

15. The cable connector of claim 1, wherein said connector housing mating face and said connector housing terminating face are on opposite sides of said connector housing.

16. A multi-terminal connector component and terminal assembly for effecting a connection between a plurality of individual conductors arranged in side-by-side order and enveloped by insulation, and an opposing connector component, comprising:

a connector housing having at least first and second distinct sides, the first of said distinct connector housing sides including a termination face at which said conductors are terminated and the second of said distinct connector housing sides including a mating face which is matable to said opposing connector component;

a plurality of conductive terminals arranged within said connector component housing, each of the terminals having insulation displacement portions formed at a first end thereof and a mating portion formed at a second end thereof, said insulation displacement terminals being arranged along said connector housing terminating face in first, second and third distinct arrays, the insulation displacement portions of said first, second and third terminal arrays being spaced apart from each other along said connector housing terminating face in a first direction and said insulation displacement portions of said first, second and third terminal arrays being spaced apart from each within each of said first, second and third terminal arrays, said terminals further including elongated mating portions that extend along said connector component mating face and which are arranged on said connector component mating face in only distinct first and second terminal mating rows, the first and second terminal mating rows being spaced apart from each other along said connector component mating face in said first direction and disposed on opposite sides of a centerline of said connector component mating face;

said terminals in said first, second and third terminal arrays having single insulation displacement portions electrically connected to corresponding single mating portions; and said terminals in said third terminal arrays having single insulation displacement portions electrically connected to multiple mating portions.

17. The connector component as claimed in claim 16, wherein all of said third terminal array insulation displacement portions are electrically connected to all of said third terminal array mating portions by a single bus bar integrally formed with said remaining terminal array insulation displacement and mating portions.

18. The connector component as claimed in claim 16, wherein selected insulation displacement portions of said first and second terminal arrays are axially aligned with selected insulation displacement portions of said third terminal array so as to permit termination of selected single conductors to two distinct insulation displacement portions of two, separate terminal arrays.

19. The connector component as claimed in claim 16, wherein all of said third terminal array mating portions are disposed in said second row of said connector component mating face.

20. The connector component as claimed in claim 18, wherein all of said third terminal array mating portions are disposed in said second row of said connector component mating face.

21. The connector component as claimed in claim 19, wherein all of said first and second terminal array mating portions are disposed in said first row of said connector component mating face.

22. An electrical cable connector for providing a connection between a plurality of individual conductors and a complementary connector component, each of said conductors having a conductive core portion extending in a first direction, said conductors including insulative portions that separate conductive core portions of adjacent conductors from each other, the connector comprising:

a connector housing having a mating face for mating with the complementary connector component, and a terminating face that receives said conductors thereon in an orientation for termination, a plurality of conductive terminals disposed in said connector housing for providing conductive paths through said connector housing and between said connector housing mating and terminating faces, the terminals being arranged in first, second and third distinct arrays of terminals along said connector housing mating face and further being arranged in distinct first and second terminal rows along said connector housing terminating face, said terminals in said first and second terminal arrays each having an elongated mating portion disposed along said connector housing mating face and an conductor-engaging portion that is disposed along said connector housing terminating face in said first terminal mating rows, said terminals of said third terminal array having respective conductor-engaging portions that are disposed along said connector housing terminating face and respective elongated mating portions that disposed along said connector housing mating face in said second terminal mating row thereof, said second terminal array being disposed along said connector housing terminating face adjacent to said third terminal array and said first terminal array being disposed on said connector housing terminating face adjacent to said second terminal array, selected conductor-engaging portions of said third terminal array being axially aligned with selected conductor-engaging portions of either of said first and second terminal arrays, to thereby permit dual termination of selected single conductors to different terminals of at least two of said three terminal arrays.

23. The connector set forth in claim 22, wherein said plurality of conductors includes a plurality of insulated wires arranged in side-by-side order.

24. The connector set forth in claim 22, wherein said plurality of conductors includes an extent of flexible circuitry having a plurality of conductive traces.

25. The connector set forth in claim 22, wherein said plurality of conductors includes a length of ribbon cable.

26. The connector set forth in claim 22, wherein said conductor-engaging portions of said terminals of said third array include insulation displacement portions.

27. The connector set forth in claim 22, wherein said connector housing includes a receptacle portion disposed along said connector housing mating face and said mating portions of said first, second and third terminals extend into said receptacle portion.

28. The connector set forth in claim 22, wherein said connector housing mating and terminating faces are disposed on opposite sides of said connector housing.

* * * * *